US005623799A

United States Patent [19]

Kowalski et al.

[11] Patent Number: 5,623,799

[45] Date of Patent: Apr. 29, 1997

[54] DEVICE AND PROCESS FOR MOUNTING TILES OF VARYING THICKNESS

[76] Inventors: William R. Kowalski, P.O. Box 30486, Honolulu, Hi. 96820; Clinton Taylor, 254 Huali St. #8, Honolulu, Hi. 96813

[21] Appl. No.: 400,871

[22] Filed: Mar. 8, 1995

[51] Int. Cl.[6] ..... E04F 13/08

[52] U.S. Cl. ..... 52/392; 52/391; 52/442

[58] Field of Search ..... 52/386, 387, 390, 52/391, 392, 780, 442, 568, 570, 571, 712, 384

[56] References Cited

U.S. PATENT DOCUMENTS 1,890,954 12/1932 Snyder ..... 52/390 X
4,170,859 10/1979 Counihan ..... 52/391 X
4,862,668 9/1989 DeGooyer ..... 52/390 X
5,182,891 2/1993 Slocum ..... 52/392 X

*Primary Examiner*—Creighton Smith
*Attorney, Agent, or Firm*—Martin E. Hsia

[57] ABSTRACT

A device and apparatus for aligning exterior faces of tiles of irregular thickness in which elongated alignment grooves are formed in edges of the tiles spaced apart from the exterior faces by a constant setback distance and a front tongue of a spacer shaped like an extruded cross is inserted into the groove in a first tile and then the corresponding groove in a second tile is mounted over the projecting rear tongue. The upper and lower tabs of the spacer define the separation between adjacent tiles and the front and rear tongues maintain the exterior faces of the tiles in alignment.

16 Claims, 5 Drawing Sheets

Fig. 1
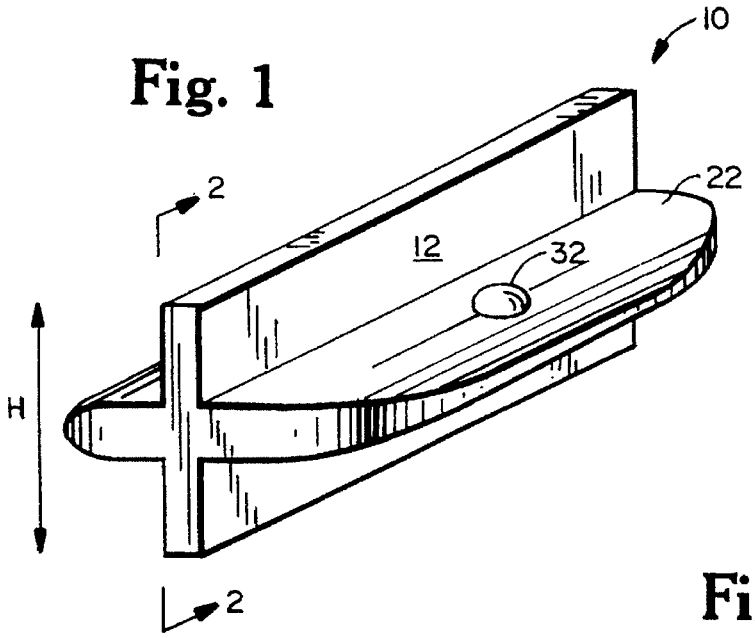
Fig. 2
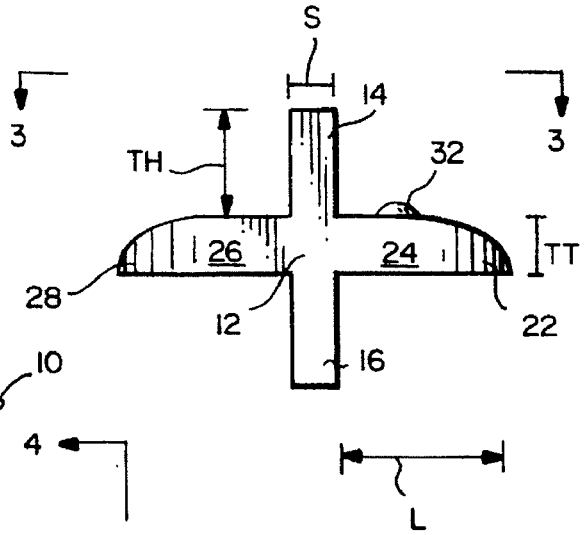
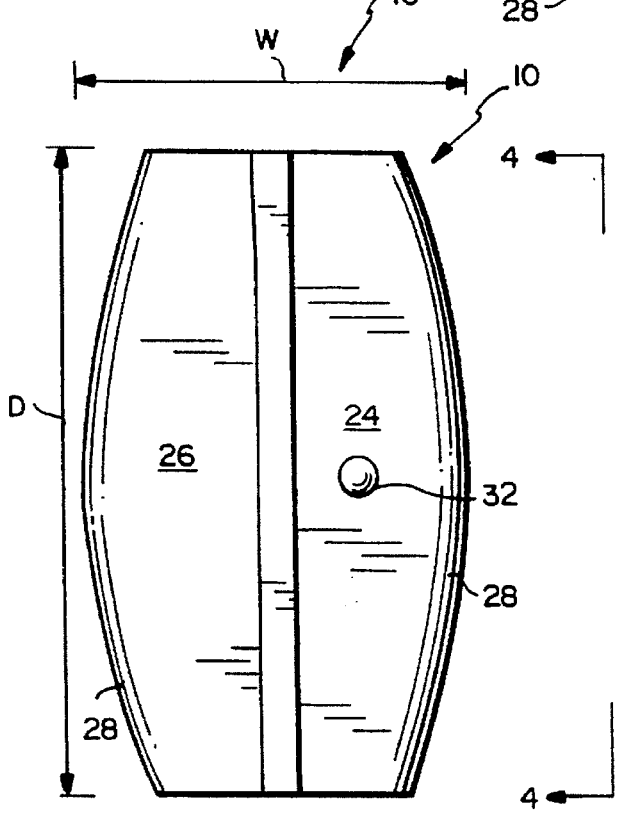
Fig. 3

Fig. 8(a)
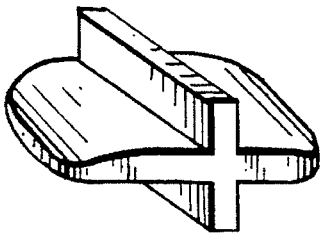
Fig. 8(b)
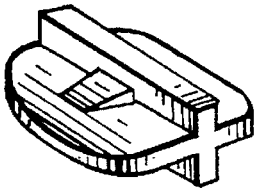
Fig. 8(c)
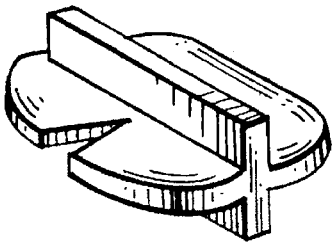
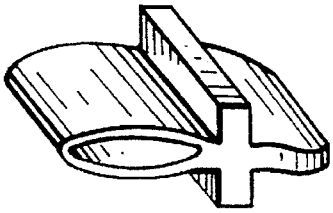
Fig. 8(d)
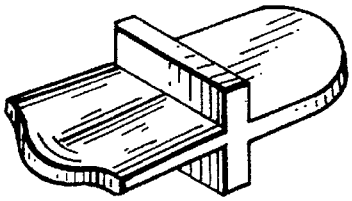
Fig. 8(e)
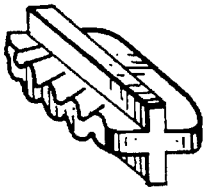
Fig. 8(f)
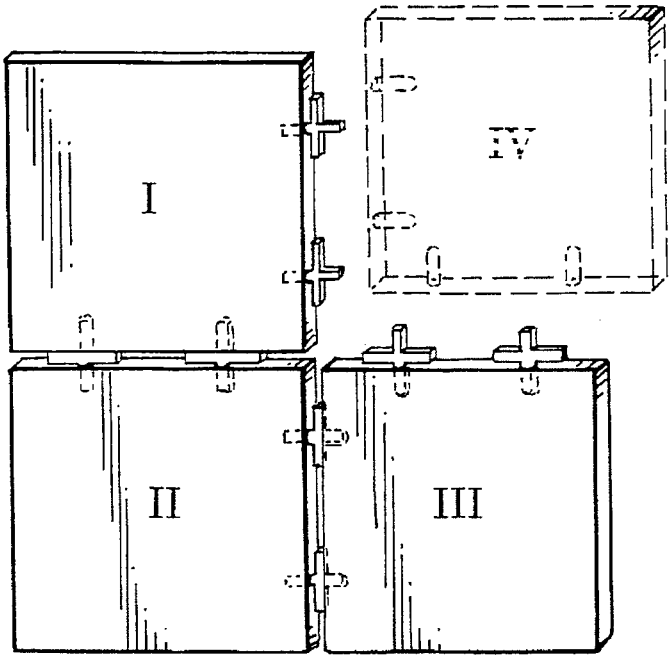
Fig. 7(a)

DEVICE AND PROCESS FOR MOUNTING TILES OF VARYING THICKNESS

DESCRIPTION

TECHNICAL FIELD

This invention relates to a device and process for aligning tiles of varying thickness.

Genuine stone materials, such as marble and granite, are often used in order to cover surfaces, such as walls and floors. These materials are often provided in tiles, so that the surfaces are covered by a matrix of tiles.

One of the major aesthetic attractions of stone tiles is the different layers of crystallized minerals, known as veins and grain patterns. Thus, dramatic veining and contrasting colors can add to the value of the stone. However, these layers of crystallized minerals also can make stone tiles more fragile. Further, after being cut and polished, they are subject to damage by chipping during transportation and storage, so that tiles of such materials are very fragile. Natural stone, marble and other materials are also dense.

Natural stone tiles are often provided with exterior faces that are polished at the quarries. However, because of natural variations in density and for other reasons, tiles made of natural stone vary considerably in thickness, with an average variation of approximately one millimeter. However, it is possible to use a precision saw to form grooves set back from the exterior face of the tiles to a tolerance of 1/1000 of an inch (0.025 millimeters).

When tiles of varying thickness are joined together, it is very difficult to obtain a flat surface. Accordingly, a great degree of skill and labor are required to produce a flat surface with uniform spacing between tiles when using these materials. Thus, the costs for installing tiles made of these materials are much higher than the costs for installing alternative tiles, such as ceramic tiles, that are of a uniform thickness, over a flat stable surface. However, the same types of problems occur when laying tiles of a uniform thickness over an irregular surface, because the surface then cannot maintain the exterior faces of the tiles flush with each other. For the same reason, if tiles of a uniform thickness are being laid over an unstable surface, such as a thick layer of glue or cement, it is difficult to maintain a flush surface.

It is therefore an object of the present invention to provide a simple device and process for laying and spacing tiles of varying thickness to form a flat surface with uniform spacing between adjacent tiles.

It is a further object of this invention to provide such a device and process that allows laying tiles of uniform thickness over an irregular or unstable surface.

It is a further object of this invention to provide such a device and process that does not require highly skilled labor.

It is a still further object of this invention to provide such a device and process that will avoid the problems of chipping and cracking inherent in prior art methods of laying tile.

It is a still further object of the present invention to provide expansion joints to absorb and distribute stress evenly among tiles.

It is a still further object of the present invention to provide such a device and apparatus that will withstand large amounts of flexing of a building without causing any damage to the installed tiles.

It is a still further object of the present invention to provide a device and apparatus that will allow installation of a tiled surface over curved or irregular subsurfaces.

BACKGROUND

U.S. Pat. No. 2,031,684 to Berger discloses a tile spacer comprising a preferably cross-shaped element, but requires that the spacers have an axial thickness substantially less than the thickness of the tiles (col. 2, lines 21–25).

U.S. Pat. No. 4,571,910 to Cosentino discloses an apparatus for laying tiles in which a plurality of grooves running perpendicularly from the edges of the tiles are formed in the rear surfaces of the tiles, and a plurality of elongated spacer elements is provided in the grooves.

U.S. Pat. No. 4,503,654 to Cosentino discloses a method and apparatus for constructing a surface from a plurality of similar polygonal tiles in which spacer members having a flat base and a rectangular flange bisecting the base are securely affixed to the rear face of the tile.

U.S. Pat. No. 4,953,341 to Joos discloses a spacer element for insertion between spaces between tiles for uniform spacing of the tiles, comprising a plurality of legs extending radially from a common juncture with the legs being formed with beveled edges to facilitate removal after an adhesive has cured.

U.S. Pat. No. 3,512,324 to Reed discloses a portable floor adapter for use over a permanent floor or over a floor covered with a rug or carpet made of several sections adapted to abut in a predetermined pattern, the sections being provided with magnets and magnetic apertures for holding the sections assembled.

U.S. Pat. No. 3,438,161 to Koch discloses a wall construction employing core positioners for spacing the core away from the walls of the forms.

U.S. Pat. No. 2,257,001 to Davis discloses a building unit and construction employing various types of joining units for slabs made of gypsum or the like.

U.S. Pat. No. 2,015,813 to Nielsen discloses the use of dowel pins and bores for joining wood block flooring.

U.S. Pat. No. 2,008,244 to Crooks discloses a self-leveling floor in which a V-shaped groove is formed along an edge of a block and a V-shaped tongue is formed on another edge with the apex of the tongue being rounded.

U.S. Pat. No. 4,680,914 to Migliore discloses a method of installing marble panels on a flat wall in which a slab or marble is cut into a plurality of thin marble sheets that are then attached to a backing panel.

U.S. Pat. No. 4,840,825 to Aristodimou discloses a tile for flooring or wall cladding with a thin stone layer bonded to a substrate made of three sublayers and with the sublayers displaced to define tongues and grooves.

DISCLOSURE OF INVENTION

The device of this invention comprises a spacer in the shape of an extruded cross. The body of the cross defines upper and lower tabs and the cross bar defines front and rear tongues. Preferably the extruded depth of the cross is greater than the height and greater than the width of the cross. More preferably, the extruded depth of the cross is greater than the thickness of the tile. Preferably also, a locking means, preferably a bump, is provided on a surface of the front tongue.

The process of this invention is to form alignment grooves in edges of first and second tiles at a constant groove setback distance from the exterior faces, with the grooves being configured to receive the front and rear tongues. The front tongue of one of the spacers then can be inserted in one of the grooves so that the rear tongue projects outwardly from the groove. The rear tongue then can be received in a corresponding alignment groove in the second tile. The front and rear tongues then maintain the exterior faces of the tiles flush with each other and the tabs of the spacer maintain the edges of the tiles spaced apart and parallel to each other. The locking means on the upper surface of the front tongue preferably retains the spacer in the alignment groove of the first tile before the rear tongue is received in an alignment groove in the second tile. Preferably the exterior edges of the tongues are tapered in thickness and have an elongated truncated oval shape when viewed from the top. Preferably, the grooves are substantially longer than the tongues are wide, to allow the tongues to be slidably adjusted along the length of the grooves.

BRIEF DESCRIPTION OF DRAWINGS

FIG. 1 is a perspective view of a first preferred embodiment of the present invention.

FIG. 2 is an end view of the embodiment of FIG. 1 along the line 2—2 of FIG. 1.

FIG. 3 is a top plan view of the embodiment of FIG. 1 along the line 3—3 of FIG. 2.

FIG. 7(*b*) is a front view of the tiles of FIG. 7(*a*) but with elongated grooves according to FIG. 5 and the spacer of FIG. 1.

FIG. 8(*a*) is a perspective view of an alternative embodiment in which locking means is provided by shaping the forward tongue as a wedge.

FIG. 8(*b*) is a perspective view of another alternative embodiment in which locking means is provided by providing a single ridge or wedge on the top surface of the front tongue.

FIG. 8(*c*) is a perspective view of another alternative embodiment in which locking means is provided by splitting the front tongue, with the split sections slightly offset from each other.

FIG. 8(*d*) is a perspective view of another alternative embodiment in which locking means is provided by making the front tongue hollow and deformable.

FIG. 8(*e*) is a perspective view of another alternative embodiment in which locking means is provided by forming the front tongue with an undulating edge having an "S" shape with three inflection points.

FIG. 8(*f*) is a perspective view of another alternative embodiment in which locking means is provided by forming the front tongue with an undulating edge having multiple inflection points.

BEST MODES FOR CARRYING OUT INVENTION

Figure 4:
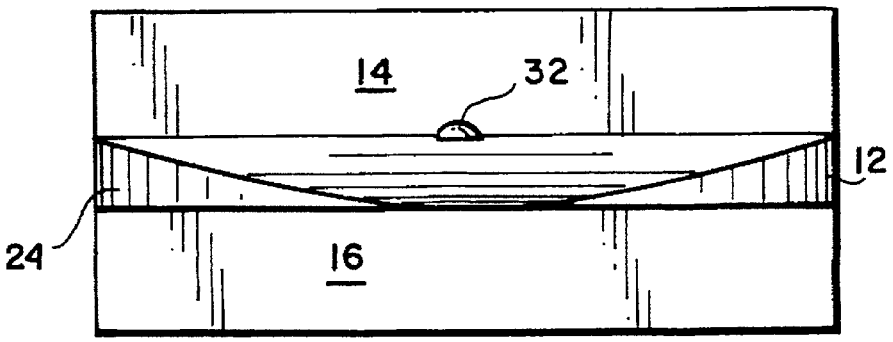
FIG. 4 is a front elevational view of the embodiment of FIG. 1 along the line 4—4 of FIG. 3.

The best mode presently contemplated for carrying out the present invention is the preferred embodiment illustrated by way of example in FIGS. 1–4.

Referring to FIG. 1, shown is a perspective view of a first presently preferred embodiment which comprises a spacer 10 substantially in the shape of an extruded cross, preferably with the crossbar having the shape of an elongated oval truncated at both ends, and being preferably tapered downward at the outer edges. The spacer 10 comprises a main portion 12 having a maximum height H and crossbar portion 22 having a maximum width W (as better shown in FIG. 3).

FIG. 2 shows a view of the spacer 10 along the line 2—2 of FIG. 1. The main body 12 defines an upper tab 14 and a coplanar lower tab 16, each preferably of the same maximum tab height TH and the same maximum thickness S. The crossbar portion 22 defines a front tongue 24 and a coplanar rear tongue 26, each preferably of a maximum tongue length L and a maximum tongue thickness TT. Preferably, the tabs 14, 16 are approximately perpendicular to the tongues 24, 26. It is further preferred that the tab height TH be less than half the thickness of the tile T so that the upper tab will not project exteriorly beyond the exterior face F when the spacer 10 is inserted in a groove, as described below. Although not preferred, it is possible to have the tab height of the lower tab 16 greater than half the thickness of the tile T (and greater than the height of the upper tab 14) so that the lower tab 16 projects inwardly beyond the interior face of the tile T, because tiles are often cemented to surfaces using relatively thick layers of glue or other adhesive, and having the lower tab 16 project inwardly beyond the interior face of the tile T may enhance the adhesion between the tile matrix and the surface to which the matrix is being adhered. Preferably a locking means for locking the front tongue 24 in a groove configured to receive the front tongue 24 is provided, preferably a locking bump 32.

It is preferred that the spacer 10 comprise a high density plastic such as polypropylene, and that the locking bump 32 be integrally formed with the body of the spacer. However, alternative materials can be used if they have the required properties of flexibility, ease of manufacturing and strength.

FIG. 3 shows a view of the spacer 10 along the line 3—3 of FIG. 2. As can be seen, from the top, the spacer 10 has the shape of an elongated oval truncated at both ends. The spacer 10 preferably has an extruded depth D and a maximum width W. Preferably the outer edges 28 of the front and rear tongues 24, 26 are arcuate so that the tongues 24, 26 can be easily visually distinguished from the tabs 14, 16 and also to conform to the configuration of the alignment grooves as described below. Preferably also, the front and rear tongues 24, 26 are tapered towards their outer edges, preferably downwardly.

FIG. 4 shows a front elevational view of the spacer 10 along the line 4—4 of FIG. 3, which makes apparent the preferred rectangular shape of the tabs 14, 16, in contrast to the preferred oval or arcuate shape of the tongues 24, 26.

Figure 5:
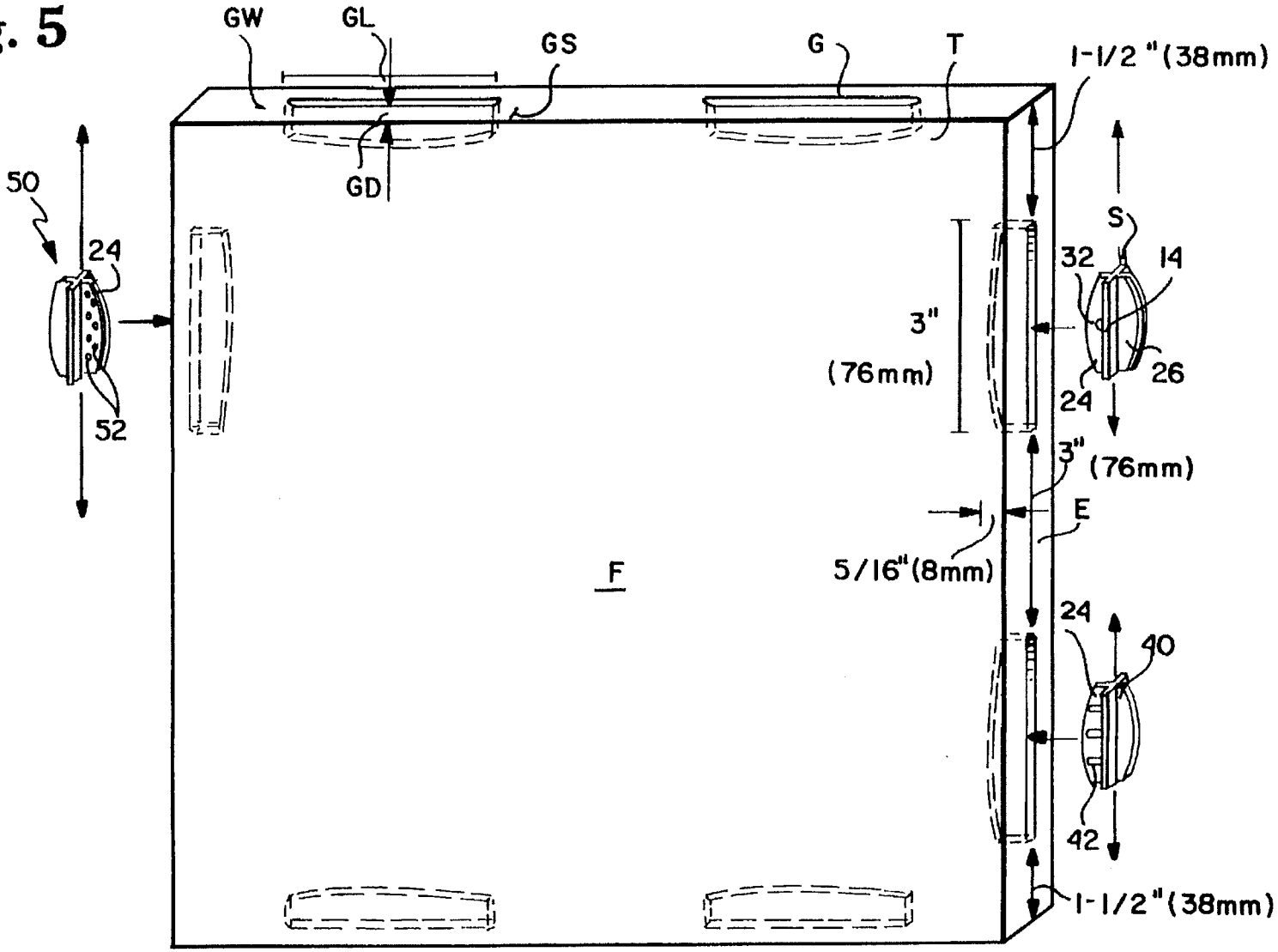
FIG. 5 is a front perspective view of a tile provided with elongated alignment grooves in accordance with the present invention showing the use of the embodiment of FIG. 1 and some alternative embodiments.

Referring to FIG. 5, shown is a perspective view of a tile T in which alignment grooves G have been formed in the edges E, which are substantially perpendicular to the exterior face F of the tile T. Preferably the grooves G are elongated and parallel to and spaced apart from the exterior face by a constant setback distance GS. The grooves G preferably have a width GW, a length GL and a depth GD. Preferably, each of the grooves G is configured to receive the tongues 24, 26 of the spacer 10. Accordingly, the maximum length L of each of the tongues 24, 26 must be less than the groove depth GD, the extruded depth D of each of the tongues 24, 26 must be less than the length of the groove GL, and the tongue thickness TT must be less than the groove width GW (except where the tongue is deformable to exert force against the walls of the groove for locking means, as shown, for example, in FIGS. 8(*b*) to (*f*)). Preferably the tongues 24, 26 fit tightly into the grooves G and preferably the locking bump 32 increases the thickness of the front tongue 24 sufficiently so that the front tongue 24 is locked inside the groove G when inserted into the groove G.

Preferably the grooves G are cut by a grooving wheel and are a constant depth GD in the central portion and curved to the radius of the grooving wheel at the ends. Preferably also, the groove setback GS is approximately half of the width of the tile. For example, two of the most common sizes for the tiles used in accordance with the present invention are 12"×12"×⅜" (300×300×20 millimeters) and 12"×12"×⅜" (300×300×10 millimeters). In such tiles, preferably two grooves having a groove length GL of 3" (76 millimeters) are formed in each edge E, separated from each other by approximately 3" (76 millimeters) and centered so that each groove is 1½" (38 millimeters) from the nearest corner, as shown in FIG. 5. Preferably also, the groove depth GD is 5/16 of an inch (8 millimeters). Preferably the groove width GW is 3/32 of an inch, or approximately 2.5 millimeters, which would leave a distance between the exterior face F of the tile T and the edge E of the groove G of ⅜ of an inch, or approximately 10 millimeters, with the distance between the groove and the opposite face of the tile therefore being approximately 9/32 of an inch or approximately 7.5 millimeters.

Preferably the maximum tongue thickness TT of the spacer 10 is approximately 3/32 of an inch (2.5 millimeters) and the maximum height H of the spacer is approximately 7/16 of an inch (11 millimeters). Preferably the extrusion depth D is approximately 1" (25.4 millimeters) and the maximum width W of the spacer is approximately ⅝ of an inch (16 millimeters). Preferably also, the maximum tab thickness S of the upper and lower tabs 14, 16 is approximately 1/16 of an inch (1.5 millimeters), but this can be varied depending on the desired separation between adjacent tiles.

The exact shapes of the tongues and tabs can be varied by, for example, making the tabs arcuate and the tongues rectangular, by making the tabs into a wave shape, or by making other minor structural modifications that do not impair the functions of the tongues and tabs. All such minor structural modifications are considered to be equivalents of the present invention.

Preferably the rear tongue 26 has a tongue thickness approximately 1/1000 of an inch (0.025 millimeters) less than the groove width GW so that the rear tongue can be smoothly received in the grooves of the second tile and also slidably adjusted along those grooves.

It is preferred to provide two grooves in each edge E in order to allow for alignment either in "running bond" stacking, in which the edges of adjacent tiles are colinear, and also alternating stacking, in which the vertical edges of adjacent tiles bisect the tiles above or below them.

In the practice of this invention, at least one, but preferably two, alignment grooves G are formed in at least one, but preferably all, of the edges E of a first tile T. The front tongue 24 of a spacer 10 is then inserted into the groove G until the tabs 14, 16 abut against the alignment edge E and the front tongue 24 is locked into the groove G by the locking bump 32. After one or more spacers 10 are locked into alignment grooves G in a first tile, the rear tongues 26 project outwardly from the grooves G. The rear tongues 26 of the spacers 10 then can be received, and preferably slidably adjusted, in elongated alignment grooves G that have similarly been formed in edges of a second tile, parallel to and spaced apart from the exterior face F by the same setback distance GS. When the second tile is thus mounted on the rear tongue or tongues 26, the second tile can be slid along the rear tongue or tongues 26 because the elongated alignment grooves G are substantially longer than the extruded depth of the rear tongue or tongues 26. This sliding allows edges of the tiles to be easily aligned in the direction parallel to their edges, so that the tiles can be aligned side to side and up and down because the lengths of the edges of natural tiles vary. Further, when the second tile is thus mounted on the rear tongue or tongues 26 and the edge of the second tile abuts against the tabs 14, 16, the tab thickness S defines the separation between the first and second tiles and the tongues 24, 26 align the exterior faces of the first and second tiles flush with each other (in a substantially coplanar relationship).

This invention also can be practiced with alternative embodiments of a spacer. For example, referring to FIG. 5, shown is an alternative embodiment 40 in which one or, preferably, a plurality of ridges 42 are provided as a locking means on the front tongue 24. FIG. 5 also shows another alternative embodiment 50 in which a plurality of bumps 52 forms a pebbled surface on the front tongue 24.

Figure 6:
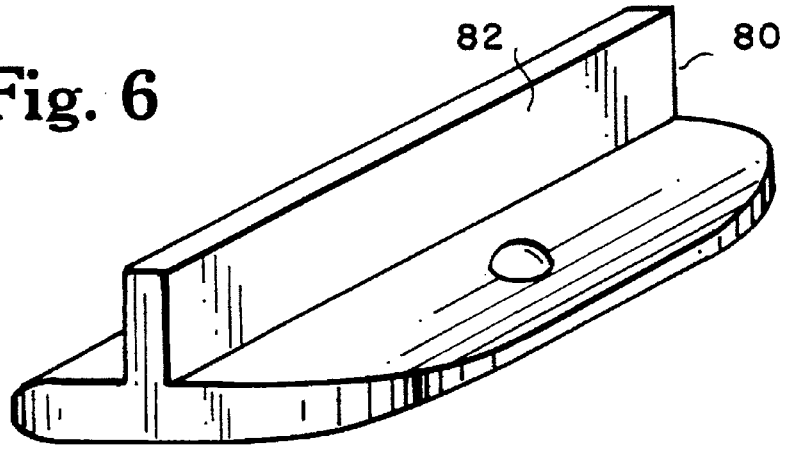
FIG. 6 is a perspective view of an alternative embodiment of the present invention with a T shaped cross section.

Referring to FIG. 6, shown is still another alternative embodiment 80 of the present invention which is identical in all respects to the embodiment 10 of FIG. 1, except that the lower tab 16 has been omitted because the upper tab is sufficient for maintaining the appropriate separation between adjacent tiles, thus forming a T cross section.

Of course, in either the cross or T embodiments, it is not necessary that the upper (or lower) tabs extend along the entire depth dimension of the spacers, so that the portions of the tabs, for example, near the ends or in the middle, or in other portions, can be removed in order to reduce the amount of material used in forming each spacer.

An advantage of the present invention is that only a minimal amount of natural stone material is removed to produce the grooves, and the material is removed from an area that does not significantly impair the strength of the tiles (tiles are most susceptible to damage at the corners).

This invention completely eliminates stone-to-stone contact during installation. The edges E do not touch during installation and any impact between adjoining adjacent tiles is cushioned by the spacers. Further, the spacers allow up to 30 degrees of tilting between adjacent tiles without contact at the fragile cornerline between the exterior face F and the edge E. This ability to allow angular movement between the tiles is useful for plumb and level adjustment and also for covering curved surfaces. Thus, the spacers are effective in reducing the chipping and cracking which may otherwise occur when the cornerlines between the edge E and the exterior face F come in contact when spacers are not used. It is important to prevent chipping and cracking for appearance and strength of any tile matrix. Further, chipping, cracking and poor spacing will result in an inferior split surface that is weaker, more difficult to clean and maintain, and subject to more rapid deterioration.

The flexibility of the spacer and the ability to precisely control the spacing between adjacent tiles by varying the thickness S of the upper and lower tabs 14, 16 allows the spacers to serve as an expansion joint. If the tiles expand, the spacers can absorb and distribute stress evenly among the tiles in the matrix. This provides a particularly effective advantage when the spacers are used in connection with flexible or semi-flexible cements. Further, because the exterior wall of the groove G (the wall closest to the exterior face F) is thicker than the interior wall of the groove G (the wall farthest from the exterior face F), if the expansion of the tile T is too great, the interior wall of the groove G will tend to break away, thus preserving the exterior face F of the tile. This ability to serve as an expansion joint can be beneficial in many applications, especially where the tiles will be exposed to substantial fluctuations in temperature and moisture in either interior or exterior environments.

Preferably the spacers are flexible and soft in comparison to natural stone tile, yet have high tensile and compressive strength so that they add to the structural integrity of the matrix. This is important because many building structures are constructed to flex in the event of hurricanes, earthquakes or other natural disasters. Thus, a tile matrix constructed using the spacers of this invention can withstand substantial amounts of such flexing without any damage to the exterior face F provided that the proper types of cement are used. The strength added to the tile matrix by the present invention also improves the safety of the finished tile matrix by reducing the likelihood that any single tile could separate from the matrix. Many building codes require that heavy wall tiles be secured with a wire and loop to prevent dislodging from the matrix. This procedure requires drilling holes in the back of each tile, affixing wires into the hole and then fastening the wires to the walls. This is a tedious, labor intensive and costly additional procedure. Using the present invention can greatly simplify installation of a tile matrix either by totally eliminating the necessity of a wire and loop construction, or substantially reducing the number of tiles that need to be wired.

Preferably the spacers are flexible and automatically retain the grout space and flatness of the tile matrix even when installed over curved or erratically irregular subsurfaces. Such irregular subsurfaces are commonly encountered in exterior applications.

In the present invention, it is preferred that the spacers 10 have an extruded depth greater than their height, greater than their width (and greater than the tile thickness), and preferably approximately twice the greater of their width or height, in order to overcome various problems that would arise with relatively flat spacers. First, relatively flat spacers (both crosses and Ts) would be much easier to dislodge from the grooves during installation because a much smaller surface area on the front tongues would be received in the grooves of the first tiles. Second, deeper spacers have more stability and strength, especially when using flexible materials, when second tiles are mounted on the rear tongues and slid over those tongues. Third, because the length of the tongues is relatively short (preferably approximately 5/16 inches (8 millimeters), a deeper spacer is easier to grasp. Fourth, a deeper spacer is better able to align and space tiles if there are chips or irregularities in the grooves because deeper spacers have more surface area on the tongues to be received in the grooves. Fifth, a spacer with a greater extruded depth D allows the depth of the grooves GD to be shallower, thus requiring the removal of less material in forming the groove G, which preserves the strength of the tiles during packing, shipping and installation. Sixth, a spacer with greater extruded depth D also allows for a narrower groove width GW, which is especially important with thinner tiles. Seventh, a spacer with greater extruded depth D distributes the stress on the tile caused by the spacer over a greater area of the groove walls, and away from the center of the length of the groove (which is the weakest part). For all of the above reasons, a spacer with greater extruded depth allows for a spacer that is easy to use and that creates a stronger and more easily installed tile matrix.

Figure 7B:
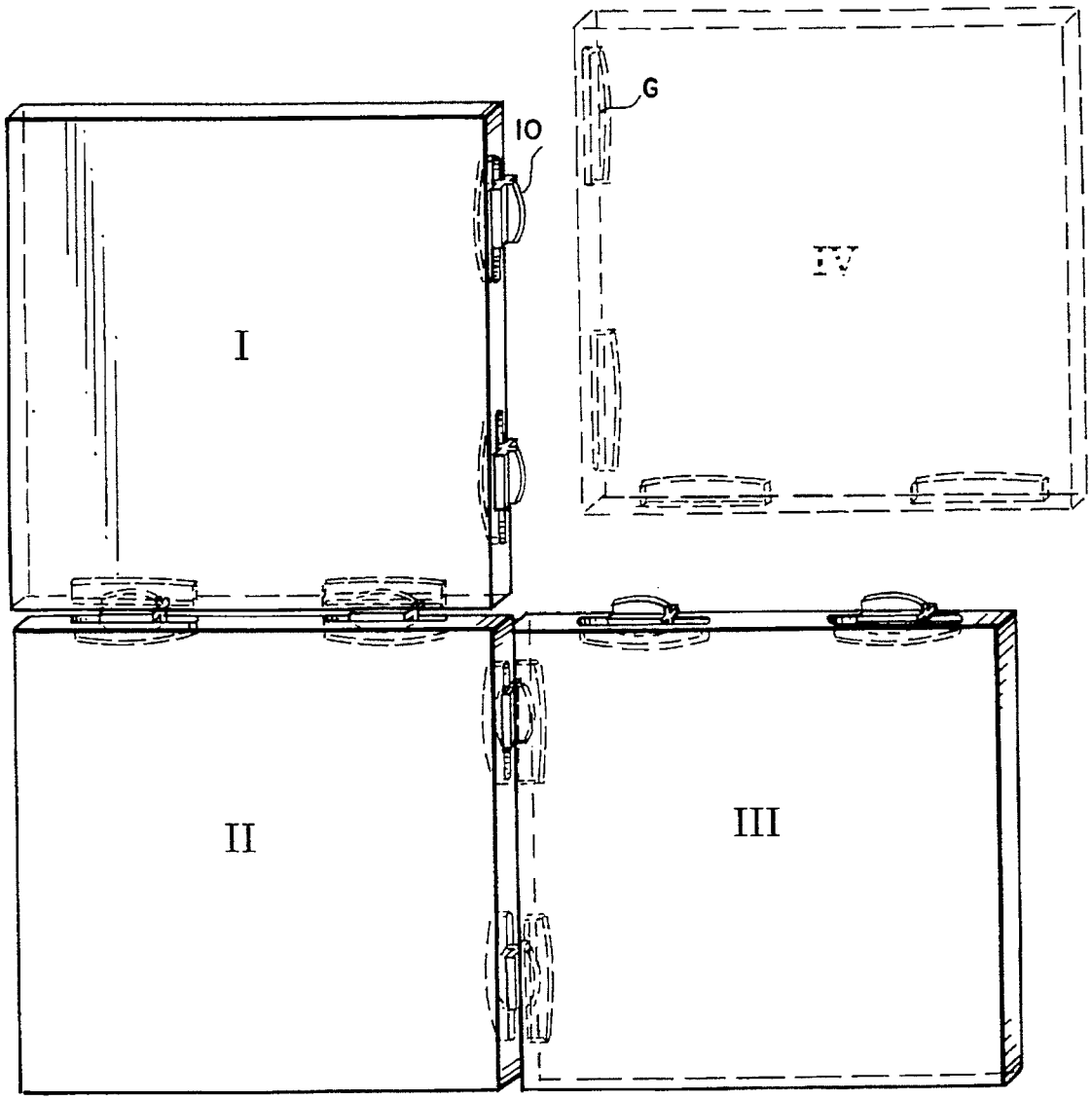
FIG. 7(*a*) is a front view of a plurality of tiles in which relatively flat cross shaped spacers inserted in short apertures are used to join three tiles, showing why such cross shaped members cannot be received in corresponding short apertures of a fourth tile.

It is preferred that the grooves G be longer than the extruded depth D of the spacers in order to avoid problems of installation that can be best understood by referring to FIG. 7(*a*). Shown in FIG. 7(*a*) are three tiles I, II, III joined together to form a matrix using spacers that fit into apertures that are approximately the same length as the arms of the spacers ("short" apertures). As can be seen, the rear tongues along the left vertical edge of tile I prevent the apertures on the lower horizontal edge of tile IV from receiving the rear tongues of the spacers on the top horizontal edge of tile III. Similarly, the rear tongues of the spacers on the top horizontal edge of tile III prevent the apertures on the left vertical edge of tile IV from receiving the rear tongues of the spacers on the right vertical edge of tile I. Thus, tile IV cannot be inserted into the matrix formed by tiles I, II and III.

This kind of problem will arise with almost any type of fastener between adjacent tiles that projects beyond the edges of the tiles; when a matrix of tiles is formed and a new tile is to be inserted into the existing matrix at the intersection of two tiles, the projections from the edges of the tiles forming the intersection will obstruct the new tile from being inserted. In such a situation, the matrix must be taken apart slightly in order to allow sufficient clearance to insert the new tile.

Referring to FIG. 7(*b*), shown are the same tiles as FIG. 7(*a*) with elongated grooves instead of the short apertures of FIG. 7(*a*), and with the spacers of FIG. 1 instead of the spacers of FIG. 7(*a*). Tile IV now can be mounted on the rear tongues projecting from tiles I and III and then slidably adjusted (within the length of the grooves) in the plane of the tiles. As long as the spacers are positioned within the grooves G (and the grooves G are sufficiently long) to allow a clearance of at least a tongue length in both the horizontal and vertical directions, then tile IV can be received in the intersection of edges in the tile matrix formed by tiles I, II and III without disassembling the matrix. For example, if tile IV is inserted into the matrix horizontally from the right, the spacers in the right edge of tile I must be positioned such that their rear tongues can be received in the grooves of tile IV when tile IV is slid leftward above the rear tongues projecting upwardly from tile III, and the rear tongues of tile I must also be positioned so that, once tile IV is mounted on them, tile IV can be moved vertically downward to be mounted on the rear tongues projecting upwardly from tile III. A detailed geometric explanation of the necessary relationships between placement of the spacers in the grooves and the lengths of the grooves can be provided by a person of ordinary skill in the art, but it is sufficient to state here that the tongues and the grooves must allow sufficient clearance for tile IV to be adjusted in two perpendicular directions in the plane of the tiles by approximately a tongue length.

It should be noted that the cross shaped spacers of FIG. 7(*a*) with the crossbars oriented parallel to the tile edges are not suitable to the practice of the present invention. First, the grooves are preferably longer than the crossbars, so that the crossbars would fall into the grooves and prevent them from serving to separate the tiles. Second, even if the crossbars are made wider than the groove width, the main body is too short to maintain the crossbar parallel to the tile edge, so that the crossbar could rotate and project outwards beyond the exterior face. The cross shaped spacers of FIG. 7(*a*) may be usable if the crossbar portions are oriented perpendicular to the tile edge, but the tab height of the upper tab would need to be less than the groove setback. In any event, it is clear that the short apertures of FIG. 7(*a*) will not work well because of the need for slidable adjustment, as shown in FIG. 7(*b*).

Referring to FIGS. 8(*a*) to 8(*f*), shown are alternative embodiments with various locking means that are deemed to be equivalents of the locking means disclosed above. Of course, these equivalent locking means also can be used with the T shaped spacer of FIG. 6. In use, the various equivalent locking means frictionally lock the front tongue in a groove, either by being wedged in the groove (FIGS. 8(*a*) and 8(*b*), or by deforming and thereby exerting force against the walls of the groove. In FIG. 8(*c*), the offset portions of the front tongue would be deformed to be more coplanar when inserted in a groove, and therefore would exert forces against the walls of the groove, which would increase the friction retaining the tongue in the groove. Similarly, in FIG. 8(*d*), the hollow portion of the front tongue would be compressed by the walls of the groove and exert force against those walls to increase the retaining frictional force. In FIG. 8(*e*), the "U" shaped edge would be compressed by the walls of the groove to be straighter and would therefore exert force against the walls of the groove, thus increasing the retaining frictional force. Similarly, in FIG. 8(*f*), the undulating edge with multiple inflection points would be compressed by the walls of the groove and exert force against those walls to increase the frictional retaining force.

Although deeper spacers are preferred, it is possible to practice this invention with relatively flat spacers, that is, spacers with an extruded depth less than the cross height and cross width (and, indeed, as shallow as ¼ inch, or approximately 7 millimeters), if sufficiently strong locking means are provided to compensate for the smaller surface area of the tongues in contact with the grooves (which creates proportionately less friction to lock the tongues in the grooves).

Even with relatively flat spacers, it is preferred, but not required (as long as sufficiently strong locking means is provided) that the extruded depth be more than ¼ inch (approximately 7 millimeters), and be more than the tile thickness. Of course, this would require that the grooves be sufficiently long to allow slidable adjustment of the tiles along the tongues to avoid the problem illustrated in FIG. 7(*a*).

While the present invention has been disclosed in connection with the presently preferred embodiments described herein, it should be understood that there may be other embodiments that fall within the spirit and scope of the invention, as defined by the claims.

INDUSTRIAL APPLICABILITY

This invention can be used in any application in which it is desired to align the exterior faces of tiles of varying thicknesses and to control spacing between adjacent tiles. This invention also can be used where tiles must be allowed to be positioned at angles to each other (for example, to cover irregular or unstable surfaces) or where tiles are subject to expansion or contraction due to, for example, differing temperatures.

What is claimed is:

1. A device, comprising:

an extruded cross having a cross height, a cross width, and an extruded depth, defining substantially coplanar upper and lower tabs and substantially coplanar front and rear tongues having upper and lower surfaces, said tongues being substantially perpendicular to said tabs;

said extruded depth being greater than said cross height and greater than said cross width; and at least one locking bump on a surface of said front tongue.

2. A device according to claim 1, wherein said extruded cross and said locking bump are integrally formed from a flexible material.

3. A device, comprising:

an extruded T defined by a body having a body height, a crossbar having a crossbar width perpendicularly mounted at one end of said body, and an extruded depth, said body defining a tab and said crossbar defining substantially coplanar front and rear tongues having upper and lower surfaces, said tongues being substantially perpendicular to said tab;

wherein said extruded depth is greater than said body height and greater than said crossbar width; and locking means for locking said front tongue in an alignment groove configured to receive said front tongue when said front tongue is inserted into said groove.

4. A device according to claim 3 wherein said locking means comprises:

at least one locking bump on a surface of said front tongue.

5. A device according to claim 4 wherein said extruded T and said bump are integrally formed from a flexible material.

6. A device, comprising:

an extruded cross having a cross height, a cross width and an extruded depth, defined by a main part and a substantially perpendicular crossbar part, said crossbar part defining a front tongue with a maximum tongue length and a maximum tongue thickness, and a substantially coplanar rear tongue with a maximum tongue thickness equal to said maximum tongue thickness, said tongues having upper and lower surfaces, said main part on a first side of said crossbar part defining an upper tab with a maximum tab height and a maximum tab thickness, and said main part on a second side of said crossbar part defining a lower tab;

wherein said cross depth is greater than said cross height and greater than said cross width; and locking means for locking said front tongue in an alignment groove configured to receive said front tongue when said front tongue is inserted into said groove.

7. A device, comprising:

an extruded cross having a cross height, a cross width, and an extruded depth, defining substantially coplanar upper and lower tabs and substantially coplanar front and rear tongues having upper and lower surfaces, said tongues being substantially perpendicular to said tabs; and locking means for locking said front tongue in a groove configured to receive said front tongue when said front tongue is inserted into said groove.

8. A device according to any one of claims 3, or 5, wherein said locking means comprises:

at least one locking bump on a surface of said front tongue.

9. A device according to any one of claims 3, 4, or 5, wherein said locking means comprises:

at least one ridge on a surface of said front tongue.

10. A device according to claim 8, wherein said extruded cross and said bump are integrally formed from a flexible material.

11. A device according to claim 10, wherein said flexible material comprises plastic.

12. A device according to any one of claims 2, 7, 10 or 6, wherein said tongues are tapered at an outer edge.

13. A device according to any one of claims 2, 7, 3 or 5, wherein said tongues are arcuate at an outer edge.

14. A process for aligning and uniformly spacing a first tile and a second tile, each tile having an exterior face, at least one alignment edge substantially perpendicular to said exterior face, a tile thickness greater than a minimum edge thickness, and at least one elongated alignment groove in said alignment edge parallel to and spaced apart from said exterior face by a groove setback, each alignment groove having a groove length, a groove width and a groove depth, wherein said groove width is less than said minimum edge thickness, comprising:

inserting a front tongue of an extruded cross shaped spacer into an alignment groove in said first tile, wherein said inserting step is performed using a spacer comprising:

an extruded cross having a cross height, a cross width, and an extruded depth, defining substantially coplanar upper and lower tabs with a tab width, and substantially coplanar front and rear tongues with a tongue width having upper and lower surfaces, said tongues being substantially perpendicular to said tabs;

said extruded depth being greater than said cross height and greater than said cross width; and locking means for locking said front tongue in said alignment grooves;

wherein said tongues are configured to be received in said alignment grooves;

whereby said front tongue of each of said spacers is retained in said alignment groove in said first tile, said tabs abut against said alignment edge of said first tile, and said rear tongue projects outwardly from said alignment groove in said first tile; and receiving said rear tongue in an alignment groove of said second tile until said alignment edge of said second tile abuts against said tabs, whereby said exterior face of said second tile is retained in a substantially coplanar relationship with said exterior face of said first tile and said alignment edges of said tiles are retained parallel to and spaced apart from each other by said tab thickness.

15. A process for aligning exterior faces of first and second tiles and maintaining said tiles at a desired separation, each tile having an alignment edge substantially perpendicular to said exterior face, comprising:

forming elongated alignment grooves in each of said alignment edges parallel to and spaced apart from said exterior faces by a constant setback distance;

inserting a spacer in one of said alignment grooves in said first tile;

wherein said inserting step is performed using a spacer shape of an extruded cross, comprising a main part and a crossbar part, said main part defining substantially coplanar upper and lower tabs having a maximum tab thickness equal to said desired separation, and said crossbar part defining substantially coplanar front and rear tongues configured to be receivable in said alignment grooves;

wherein said front tongue is inserted into one of said alignment grooves in said first tile until said tabs abut against said alignment edge of said first tile;

whereby said rear tongue projects outwardly from said first tile; and receiving said rear tongue in one of said alignment grooves in said second tile until said tabs abut against said alignment edge of said second tile.

16. A device, comprising:

an extruded cross having a cross height, a cross width, and an extruded depth, defining substantially coplanar upper and lower tabs and substantially coplanar front and rear tongues having upper and lower surfaces, said tongues being substantially perpendicular to said tabs;

said extruded depth being greater than said cross height and greater than said cross width; and at least one ridge on a surface of said front tongue.

* * * * *